United States Patent [19]

Nasca

[11] 3,930,278

[45] Jan. 6, 1976

[54] PAINTBRUSH AND GUARD ATTACHMENT FOR EDGING

[76] Inventor: Richard A. Nasca, 350 Bank St., Painesville, Ohio 44047

[22] Filed: Apr. 10, 1974

[21] Appl. No.: 459,696

[52] U.S. Cl. ..... 15/166; 15/248 R

[51] Int. Cl.[2] ..... A46B 17/00; B44D 3/22

[58] Field of Search..... 15/166, 248 R, 248 A, 246, 15/437; 33/39 B, 41 F; 273/19 R, 19 A, 19 B; 294/19 A; 401/48, 193

[56] References Cited

UNITED STATES PATENTS

| | | | |
|---|---|---|---|
| 922,074 | 5/1909 | Bangert | 401/48 |
| 1,915,893 | 6/1933 | Kinpoitner | 15/166 |
| 2,078,193 | 4/1937 | Campbell | 15/166 |
| 2,116,406 | 5/1938 | Nancarrow | 15/166 |
| 2,807,041 | 9/1957 | Watro | 15/248 R |
| 2,820,237 | 1/1958 | Maslaney | 15/248 R |
| 3,401,418 | 9/1968 | Deck et al. | 15/166 |
| 3,824,647 | 7/1974 | Deck et al. | 15/248 R |

FOREIGN PATENTS OR APPLICATIONS

| | | | |
|---|---|---|---|
| 1,033,626 | 6/1966 | United Kingdom | 15/248 R |

*Primary Examiner*—Daniel Blum
*Attorney, Agent, or Firm*—William N. Hogg

[57] ABSTRACT

A device for removable attachment to a paintbrush to assist in cutting-in one flat surface to another is disclosed. It is formed of flat metal sheet cut to a configuration having a central portion with a foot depending from one end thereof and a pair of bendable arms extending laterally therefrom. The arms can be bent to a plane normal to the plane of the central portion to engage the opposite sides of the handle of a paintbrush, and the foot portion acts as a guide and shield against unintentional smearing.

5 Claims, 5 Drawing Figures

PAINTBRUSH AND GUARD ATTACHMENT FOR EDGING

BACKGROUND OF THE INVENTION

This invention relates generally to removable attachments for paintbrushes, and more particularly to an attachment device for use on a paintbrush to assist in forming straight uniform edges at the interface of intersecting surfaces and allow application of paint to the intended surface while preventing unintentional smearing of paint of the other surface, commonly referred to as "cutting-in."

This operation of "cutting-in," i.e., painting up to the edge of one surface where it intersects with the edge of another surface without smearing paint and still obtaining a straight even edge is one of the more difficult techniques, especially for amateur, or do-it-yourself painters. Good smooth mating surfaces which are straight and which are free of smeared paint present a very pleasing appearance and add greatly to the attractiveness of any paint job. These surfaces often are where a ceiling meets the walls with the ceiling and walls being painted a different color, thus requiring a good straight even interface.

There have been many different prior art proposals for devices which are adapted to be applied to or used in conjunction with paintbrushes to assist in "cutting-in." However, each of these devices have suffered certain serious drawbacks which have prevented any of them from gaining widespread acceptance or use. For example, many of them are difficult to apply to the paintbrush or can be adapted only to one size paintbrush or require special fittings to be applied to the paintbrush. Also, many of them do not allow for easy dipping of the brush into the paint can without smearing on the device and therefore detracting from its usefulness. Also, many of these devices are awkward to use and in some cases must be separated from the paintbrush thereby requiring two hands to do the operation.

SUMMARY OF THE INVENTION

According to the present invention a device for use on a paintbrush to assist in forming straight uniform edges at the interface of intersecting surfaces and allow application of paint to the intended surface while preventing unintentional smearing of the paint of the other surface is provided which device easily can be attached to and removed from various sizes and configurations of paintbrushes, which is easy to use, which will allow straight work up close to or at the interface without unintentional smearing, and which can be easily manipulated to allow the paintbrush to be dipped into the paint without smearing, and which device can be economically and easily manufactured.

DESCRIPTION OF THE PREFERRED EMBODIMENT

Figure 1:
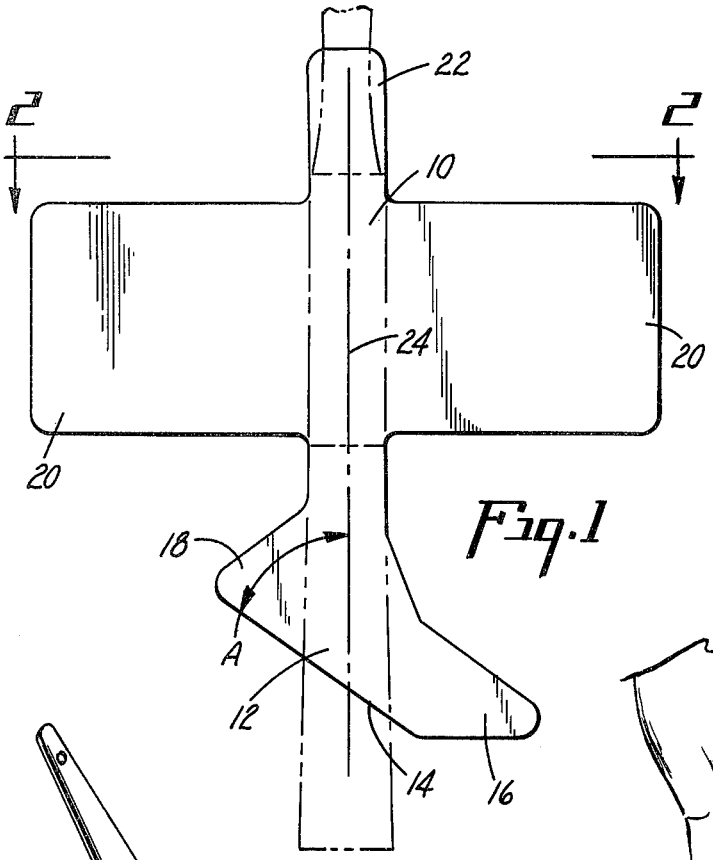
FIG. 1 is a plan view of a device according to this invention as it is normally manufactured and sold and shown positioned in relationship to a paintbrush shown in phantom ready to be applied thereto.
Figure 2:
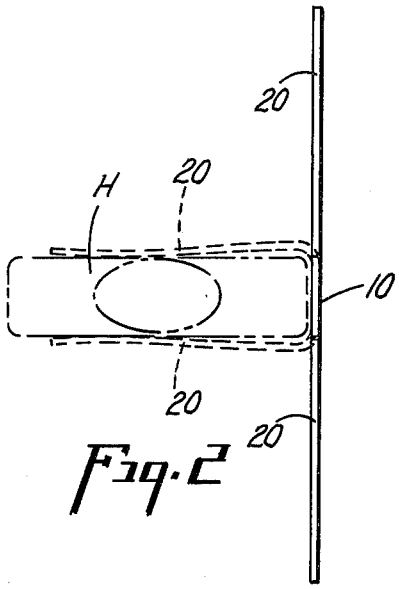
FIG. 2 is a sectional view taken substantially along the plane designated by line 2—2 of FIG. 1 and showing in dotted outline the tabs folded to engage the opposite sides of the brush.

Referring now to the drawing, one embodiment of the device for use of a paintbrush to assist in forming a straight uniform edge at the interface of intersecting surfaces and allow the application of paint to the intended surface while preventing unintentional smearing of paint of the other surface is shown. The device is a flat sheet of material, preferably sheet metal, and formed with an elongated cental portion 10 terminating at one end thereof in a foot 12. The foot 12 has a straight bottom edge 14, a toe edge 16, and a heel 18. Disposed between the foot 12 and the opposite end of the central portion 10 is a pair of tab members 20 extending transversely in opposite directions from the central portion 10. The portion of the central portion 10 extending beyond the tab members 20 forms an extension arm designated generally as 22. The device is generally manufactured and sold as a flat sheet of material as depicted in FIG. 1. The tab members are bendable and are somewhat resilient in nature and are positionable generally as shown in dotted lines in FIG. 2 in a parallel extending relationship, so that they may engage the opposite sides of the handle H of a paintbrush. With the tabs bent in one direction the device will slip onto one side of the paintbrush as shown in FIG. 3 whereas if they were bent in the opposite direction they would slip on the opposite side so that the device, depending upon the direction of bending of the tabs, can be used on either side of a paintbrush and for use in either direction of motion.

The material of which the device is formed, as noted above, preferably is a sheet metal so that the tabs 20 can be readily bent to the desired parallel configuration and once bent to this configuration will maintain this configuration, but have sufficient resiliency so that they will grippingly engage the handle of the brush and maintain its position thereon. These characteristics are readily obtainable in sheet metal and hence the preferance for this material. However, other material which exhibits these characteristics could be utilized also.

Figure 3:
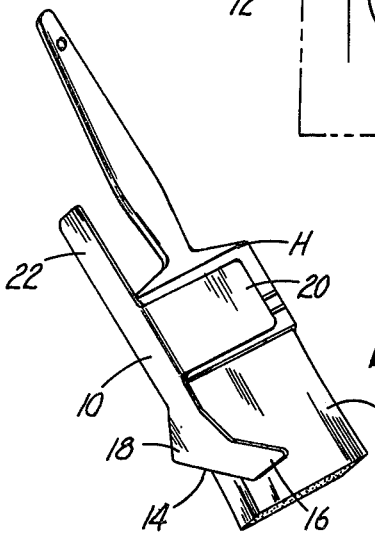
FIG. 3 is a perspective view of the device as applied to a brush.

The device when placed on the paintbrush is positioned approximately in the position as shown in FIG. 3 with the foot portion and a part of the central portion disposed adjacent one edge of the bristles B with the bottom edge 14 of the foot portion being somewhat spaced from the end of the bristles B. This allows the paintbrush to assume the position shown in FIG. 5 which is the "natural" position for the paintbrush to lay when paint is being applied. The bottom edge 14 of the foot 12 lies on and engages surface S-1 to which the paint is being applied while the remainder of the foot portion of the central portion 10 acts as a shield to prevent the edge of the bristles from smearing the paint unintentionally onto surface S-2 to which paint is not intended to be applied. Also, the device acts as a guide so that the face of it can be placed up against surface S-2 with the bottom edge 14 on surface S-1 and thereby allow a straight even line to be drawn utilizing the device as a guide snug against the surface S-2.

Figure 5:
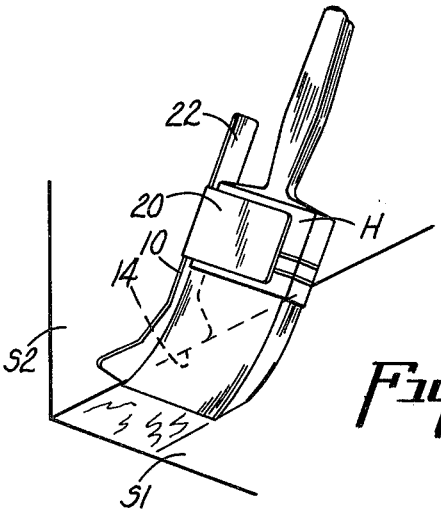
FIG. 5 is a perspective view showing the device in use on a brush for "cutting-in" one surface to another.

In order or achieve the natural angle of the brush as shown in FIG. 5 with the bottom edge 14 being in line contact with the surface S-1, the angle "A" between the bottom edge 14 and the longitudinal axis 24 of the central portion 10 must be an acute angle, and preferably should be approximately 55 degrees. The toe edge 16 should extend substantially normally to the axis 24 and the heel 18 should be disposed at an angle of about 55 degrees with respect to the axis 24. Also, preferably the toe should be rounded at the end of the toe edge 16 as shown and preferably the edge should be rounded between the edges 12 and 18.

Figure 4:
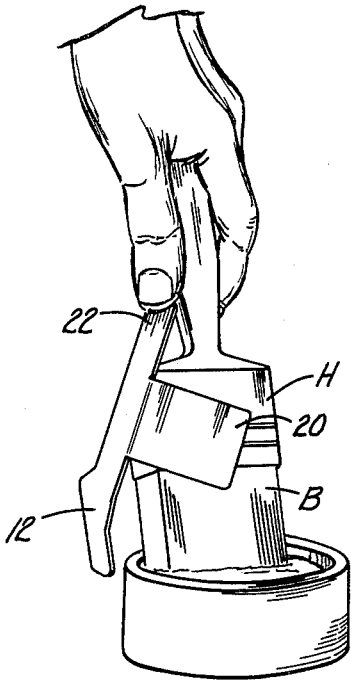
FIG. 4 is a perspective view showing the device being moved aside to allow the bristles of the paintbrush to be dipped into a paint can.

As was indicated above, the tabs 20 are spaced from the end of the central portion 10 so as to form an extension arm 22. This serves the purpose of allowing the user of the paintbrush to push against this extension arm 22 as shown in FIG. 4 to pivot the foot 12 away from the bristles of the brush so that the bristles may be dipped into a paint can without dipping the guiding and edging device into the paint. This prevents a pickup or buildup of paint on the outside face of the device thereby eliminating the tendency of this face to induce a smearing action on the unintended surface. Also, with this construction the painter can do all of the manipulations with only one hand as shown in FIG. 4 when the device is pivoted away from contact with the bristles and by pushing in a reverse direction the device will pivot back into its use position as shown in FIG. 3 after the paintbrush has been removed from the paint can.

What is claimed is:

1. A device in combination with a paintbrush having a flat handle with an enlarged bristle engaging portion to assist in forming straight uniform edges at the interface of intersecting surfaces and allow application of paint to the intended surface while preventing unintended smearing of paint on the other surface said device comprising, a flat sheet of material having an elongated central portion with an enlarged coplanar foot portion depending from one end thereof, said foot portion having a straight bottom edge disposed at an acute angle with respect to the longitudinal axis of said central portion, and a pair of bendable positionable resilient tab members extending transversely from the opposite sides of said central portion at a location spaced from said foot portion and spaced from the opposite end of the central portion, said tab members being bendable to a parallel configuration normal to the central portion to engage opposite sides of the enlarged bristle engaging portion of the handle and maintain the central portion and foot disposed along the edge of the bristles to act as an edge guide and a shield against unintended smearing while maintaining both faces of the bristles unobstructed, and with the extension of the central portion acting as an extension arm to pivot the foot out of contact with the bristles to allow for dipping into paint.

2. The invention as defined in claim 1 wherein said foot portion has a toe at one end thereof extending at an angle with respect to the bottom edge thereof.

3. The invention as defined in claim 1 wherein said bottom edge surface of the foot portion intersects the longitudinal axis of the central portion.

4. The invention as defined in claim 3 wherein the angle of intersection is approximately 55°.

5. The invention as defined in claim 1 wherein the sheet material is sheet metal.

* * * * *